US005174036A

United States Patent [19]

Lin

[11] Patent Number: 5,174,036

[45] Date of Patent: Dec. 29, 1992

[54] MULTI-FUNCTIONAL RULER

[76] Inventor: Chin-hsiu Lin, 2F, No. 7, Alley 4, Lane 100, Minli St., Chung Ho City, Taipei, Taiwan

[21] Appl. No.: 696,596

[22] Filed: May 7, 1991

[30] Foreign Application Priority Data

May 17, 1990 [CN] China ..... 90206744.3

[51] Int. Cl.[5] ..... B43L 7/04

[52] U.S. Cl. ..... 33/449

[58] Field of Search ..... 33/449, 448, 27.05

[56] References Cited

U.S. PATENT DOCUMENTS 1,511,378 10/1924 Strom ..... 33/449

3,195,235 7/1965 Regan ..... 33/449

FOREIGN PATENT DOCUMENTS 8910848 11/1989 World Int. Prop. O. ..... 33/449

*Primary Examiner*—Harry N. Haroian

*Attorney, Agent, or Firm*—Bacon & Thomas

[57] ABSTRACT

An improved multi-functional ruler is disclosed comprising a body of a ruler including an axial seat and an axial rod having convex blocks at each of its two ends attached with rollers. The convex blocks are separately connected to the interior of axial nuts. The axial nuts and the axial seats are tightly fixed together, with an axial block located at a central part of the internal lateral side of the body of the ruler. When the axial rod of the forementioned structure is set in motion, it will not cause a tremendous area of friction with the body of the ruler. It will slide smoothly without causing any position shifting of the axial rod so as to enable lines to be accurately drawn. The axial block can function as a center from which circles of different diameters can be drawn.

2 Claims, 6 Drawing Sheets

MULTI-FUNCTIONAL RULER

BACKGROUND OF THE INVENTION

1. Field of the Invention

This invention relates to a multi-functional ruler including axial seats, an axial rod, an axial nut and a roller.

2. Background of the Invention

A multi-functional ruler 40 presently on sale in the market is indicated in FIG. 1, wherein it can be seen that axial seats 41 and 42 are set on the body of the ruler 40, and a roller axial rod 30 is set on the forementioned axial seats 41 and 42. The roller axial rod 30 is formed by an internal shaft 31 which extends through an external shaft 32 and also rollers 33 and 34 which are connected by threads set separately on its two ends to internal shaft 31.

During use of the prior art ruler, the user can press the body of the ruler 40 lightly to cause the ruler to slide forward and backward. Being fixed to the axial seats 41 and 42 of the body of the ruler, the forementioned external shaft 32 will not slide. The internal shaft 31, which is set inside the forementioned external shaft 32, will follow the body of ruler 40 to enable the body of the ruler 40 to move smoothly. In spite of the fact that the roller axial rod 30 presently found on sale in the market does not incur wear and tear when the body of the ruler 40 slides since external shaft 32 is fixed into the axial seats 41 and 42 of the body of the ruler 40, and the upper, lower, front and rear direction of the forementioned rollers 33 and 34 are kept an appropriate distance from the body of the ruler 4, certain defects such as those set forth below exist:

1. Since internal and external shafts are employed by the multi-functional ruler currently on sale in the market to cause the roller to move through sliding, the surface of its internal shaft remains in touch with the internal edge of the external shaft. When the internal shaft is moving, it will cause a continuous friction with the external shaft. This frictional force will affect the smooth sliding of the internal shaft, and thus can directly hinder the work such as with engineering drawings.

2. Gaps are maintained at the periphery of the rollers on the axial rod. When the body of the ruler is sliding, due to the fact that only the external shaft of the axial rod is tightly squeezed against the interior of the axial seat on the body of the ruler, the axial rod can readily move transverse to its rolling movement, and thus will affect the precision of the drawings made. As indicated in FIG. 2, errors are found in the lines which are drawn with the help of this prior art ruler. Thus, such prior art rulers cannot achieve an accurate drawing effect.

SUMMARY OF THE INVENTION

The object of this invention is to provide an improved multi-functional ruler, wherein the improved structure can, upon use, guarantee that a sliding friction will not be produced by and between the axial rod, which is being driven by the rollers, and the body of the ruler. Furthermore, the ruler of the present invention ensures that relative movement between the axial rod and the axial seat of the body of the ruler is inhibited. In this way, the present ruler will prevent the lines which are drawn by the multi-functional ruler from becoming oblique. It will also enable the body of the ruler to move in a plane about an axial center, thus enabling the user to draw circles of different diameters.

The object of this invention will be achieved in the following way: An arc-shaped axial seat is set at the two ends of the body of the ruler. Two rollers are set on the axial rod, with convex ends protruding out of the two ends of the two axial rods to enable the two convex ends to be received within two axial nuts, which will then be separately housed tightly into the forementioned two arc-shaped axial seats with the convex ends only maintaining a sliding contact with the axial nuts. The rollers extend slightly out of the body of the ruler, and can be easily caused to slide by pushing. An axial block is set at the central position of one lateral side of the body of the ruler to enable the body of the ruler to move in a plane with the center of the axial block as its axial center.

The improved multi-functional ruler evinces certain advantages which are set below: First, the axial rod is only connected at its two ends to cause sliding and frictional movement with the axial nut which, in turn, is fixed inside the forementioned arc-shaped axial seat. In this manner, other parts of the axial rod do not remain in contact with the body of the ruler, unlike the multi-functional rulers which are currently on sale in the market which remain in sliding frictional contact with an extensive area of the external shaft when it is moving. Therefore, when the axial rod of the multi-functional ruler of this invention is moving, the relative friction it produces with and against the part it keeps in contact with will be reduced to a minimal degree, thus enabling a smooth sliding movement when it is being used. Second, the axial nut and the body of the ruler is firmly fixed together when they pass through the arc-shaped axial seat so no positional shifting will be produced in the space between the axial rod and the axial seat of the body of the ruler when the rollers are sliding. This enables the locus of sliding to have a comparatively better degree of precision, thus further guarantying the precision of any engineering drawing. Third, a circular axial block is set at a central position of one lateral side of the body of the ruler such that the body of the ruler can be moved in a plane with the center of the circular axial block as its axis, thus enabling a user to use the multi-functional ruler to draw circles of different diameters.

From this description it can be seen that the multi-functional ruler presented by this invention makes use of the tight engagement of the axial nut and the axial seat to present such advantages as the availability of the body of a ruler which will not be worn out due to its sliding movement, no corresponding positional shifting will be made by its component parts, a precision sliding locus will be ensured, and circles of different diameters can also be drawn. It will not only overcome the defects found in the prior art, but will also expand the scope of function that can be performed by rulers.

DETAILED DESCRIPTION OF THE INVENTION

Figure 1:
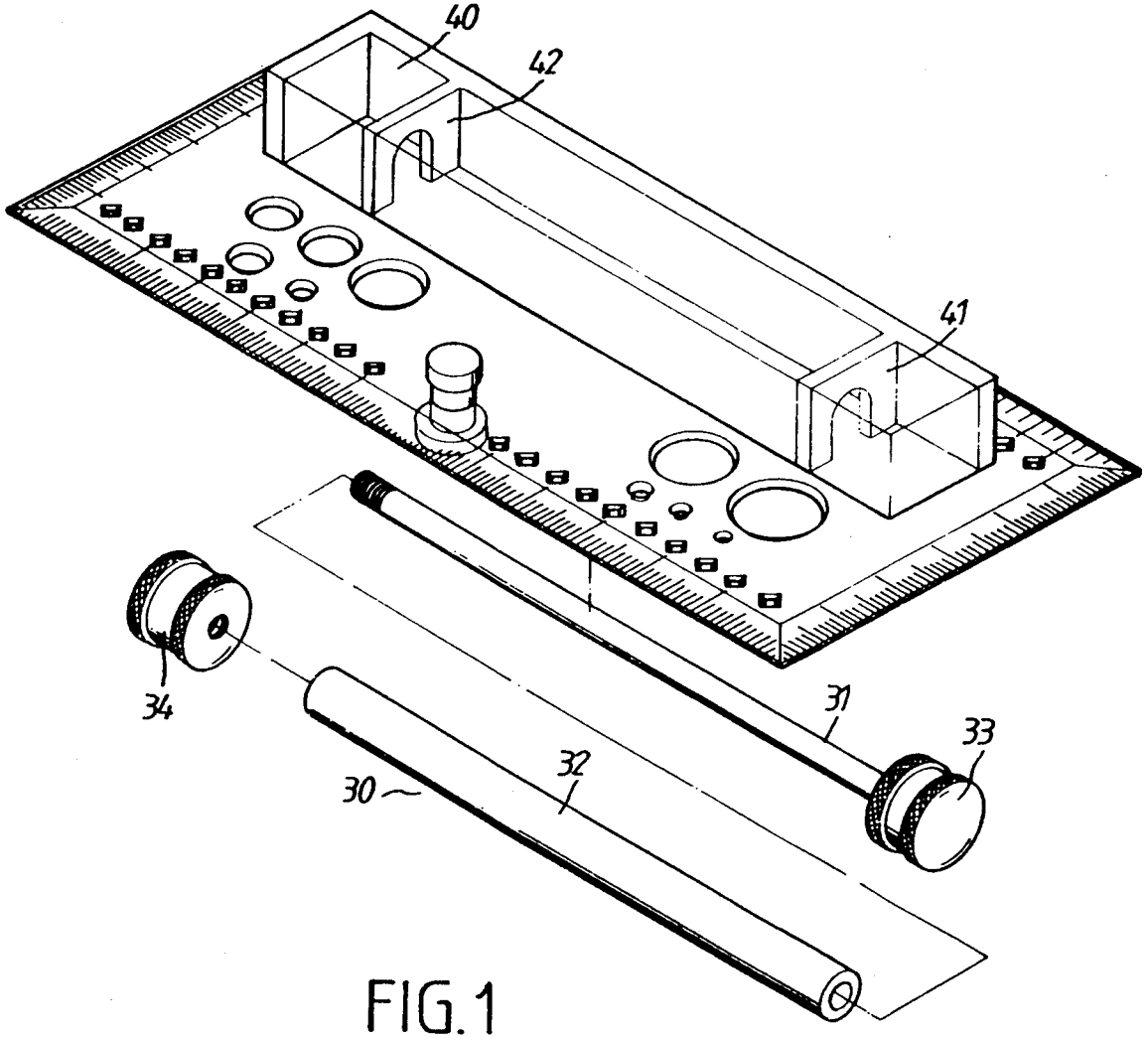
FIG. 1 (PRIOR ART)
FIG. 1 is a segmentation indicative drawing of the multi-functional rulers currently on sale in the market.
Figure 2:
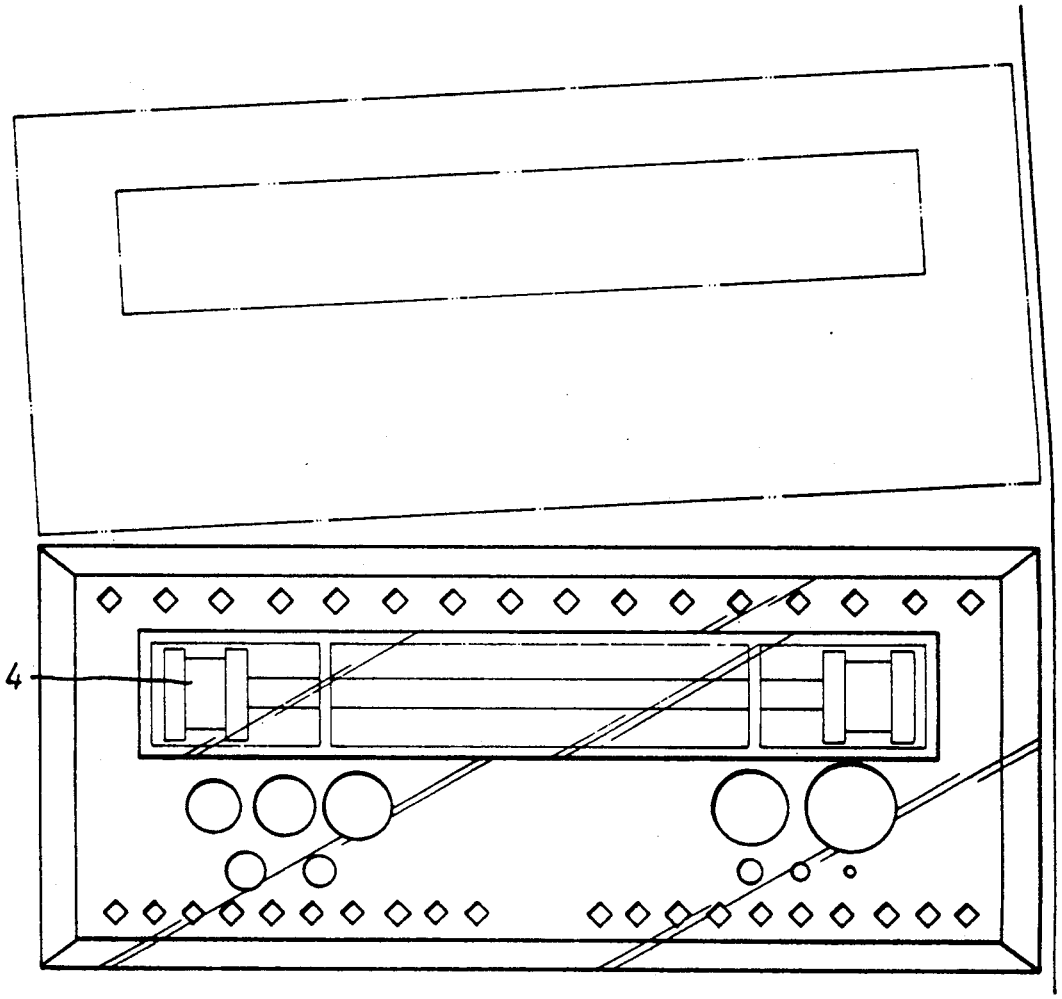
FIG. 2 (PRIOR ART)
FIG. 2 shows a multi-function ruler currently on sale in the market.
Figure 3:
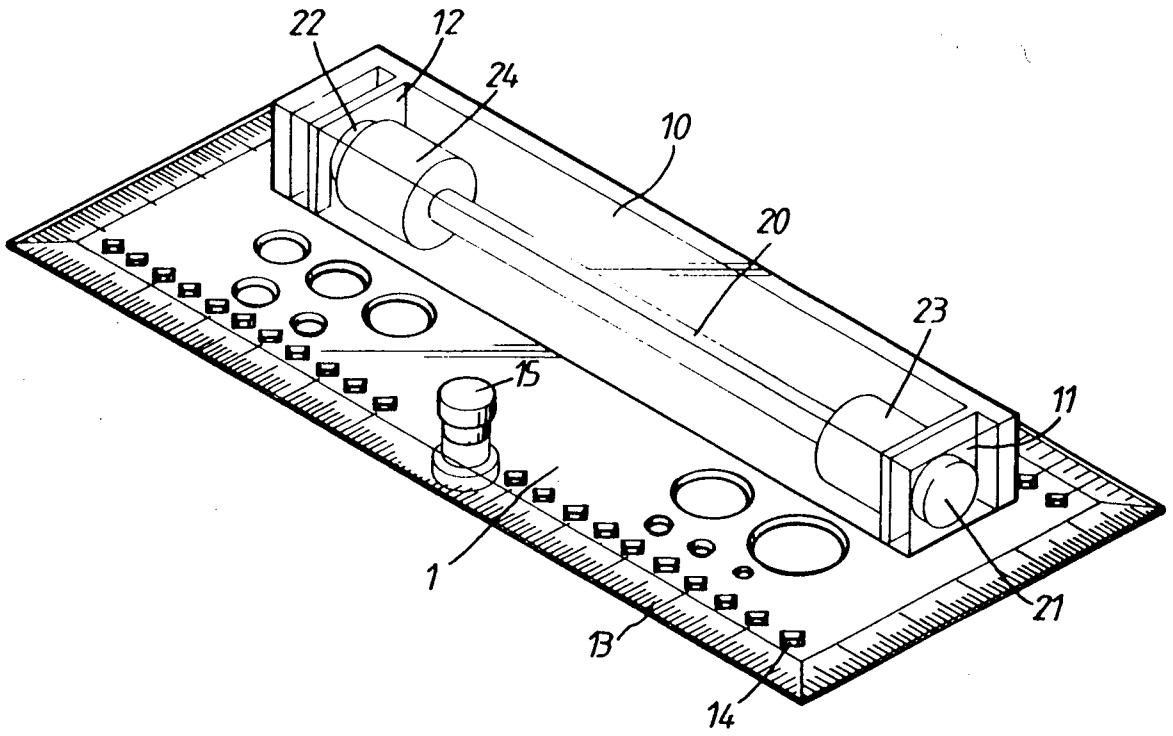
FIG. 3 is a perspective view of the multi-functional ruler of the present invention.
Figure 4:
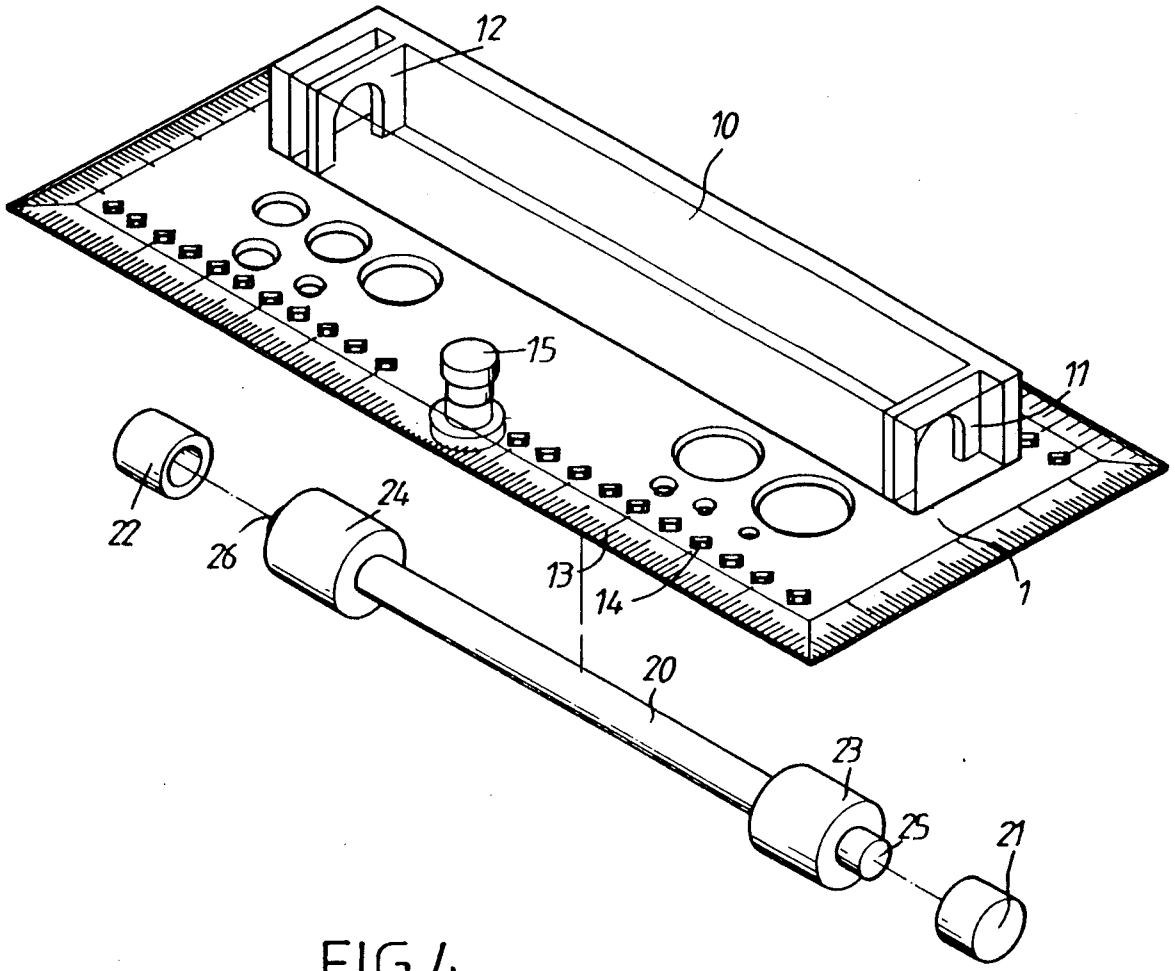
FIG. 4 depicts an exploded view of the ruler according to the present invention.

Referring to FIGS. 3 and 4, it can be seen that the multi-functional ruler of the present invention mainly comprises the body of ruler 1 and an axial rod 20. A roller groove 10 is set on the body of ruler 1, and on the two ends thereof, i.e. the two lateral sides of roller groove 10, arc-shaped axial seats 11 and 12 are set. At each of the internal lateral sides of the two ends of the forementioned axial rod 20, rollers 23 and 24 are separately secured. The two ends of the forementioned axial rod 20 form two convex support blocks 25 and 26, i.e. end portions of axial rod 20, which are separately received within and rotatably connected to axial nuts 21 and 22. Axial nuts 21 and 22 are further separately fixed (e.g. press fit) onto the axial seats 11 and 12 of roller groove 10. The peripheral face of axial nuts 21 and 22 abut a respective internal lateral face of the arc-shaped axial seats 11 and 12 without leaving any gap. The dimension of rollers 23 and 24 on the axial rod 20 is designed in such a way that axial rod 20 is fixed onto the axial seats 11 and 12 after passing through axial nuts 21 and 22. Rollers 23 and 24 protrude out the bottom face of the body of ruler 1, so that ruler 1 can easily roll on the face of a paper etc., and thus further drive the body of the ruler 1 to slide.

When the body of ruler 1 slides by way of the rollers, rollers 23 and 24 will be spaced from the internal lateral side of the roller groove 10 thus preventing wear and tear to the body of ruler 1, so as to ensure its durability. Moreover, owing to the fact that axial rod 20 is connected through blocks 25 and 26 on its two ends within axial nuts 21 and 22 respectively, the contact face will be tremendously reduced and will also relatively reduce frictional force to a minimum, and thus enable the rollers to roll more smoothly at the time of rolling.

The axial nuts 21 and 22, which are rotatably connected to the two ends of the axial rod 20, are mounted at the internal edge of the two lateral face plates of the roller groove 10 and the arc-shaped roller axial seats 11 and 12. When the rollers are in motion, this connection prevents the axial rod 20 from shifting transversely, so as to ensure that rollers 23 and 24 keep an accurate and uniform path at the time of rolling. The drawing shown in FIG. 5 illustrates that a line drawn by the body of the ruler according to the present invention is absolutely parallel to the path taken by rollers 23 and 24, and thus ruler 1 achieves excellent accuracy.

Figure 5:
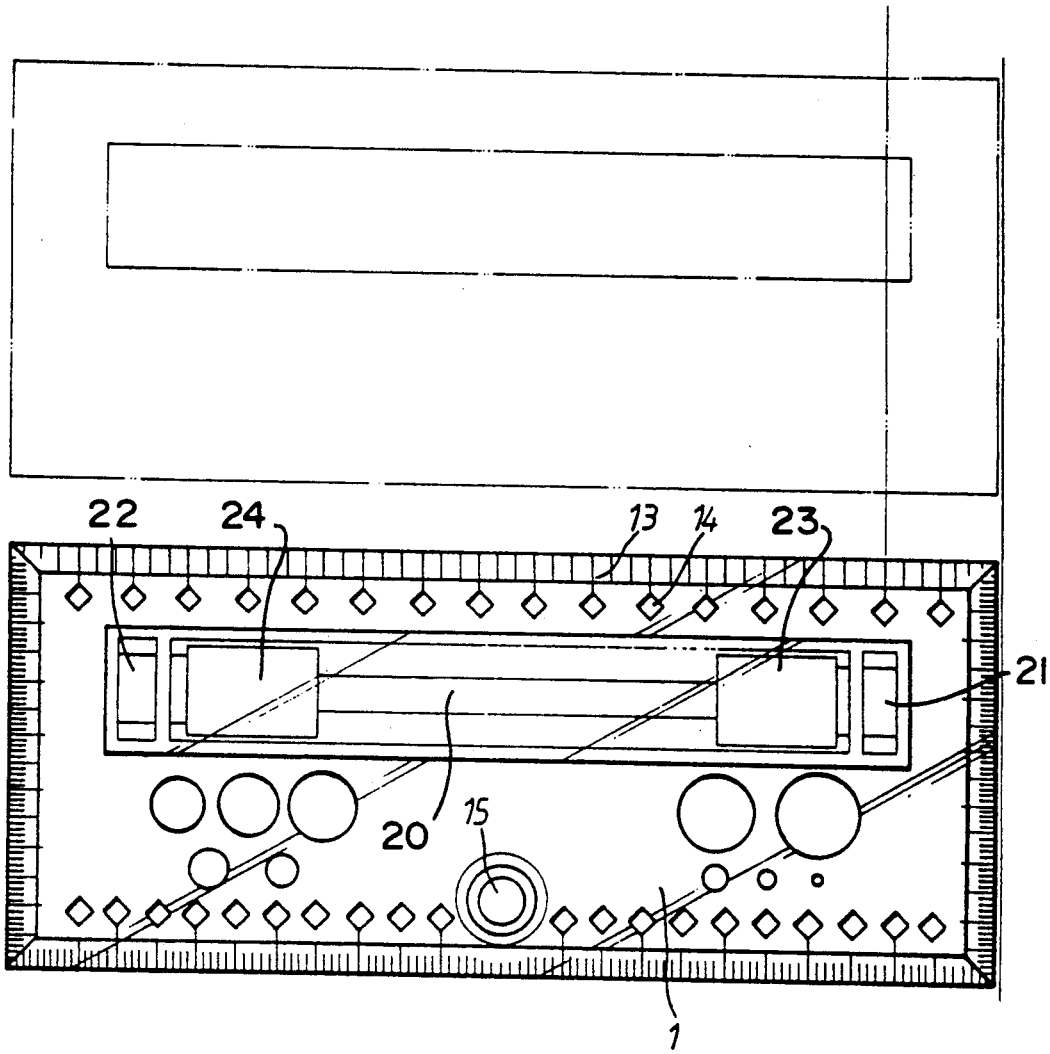
FIG. 5 shows a preferred use of the depicted embodiment of this invention.
Figure 6:
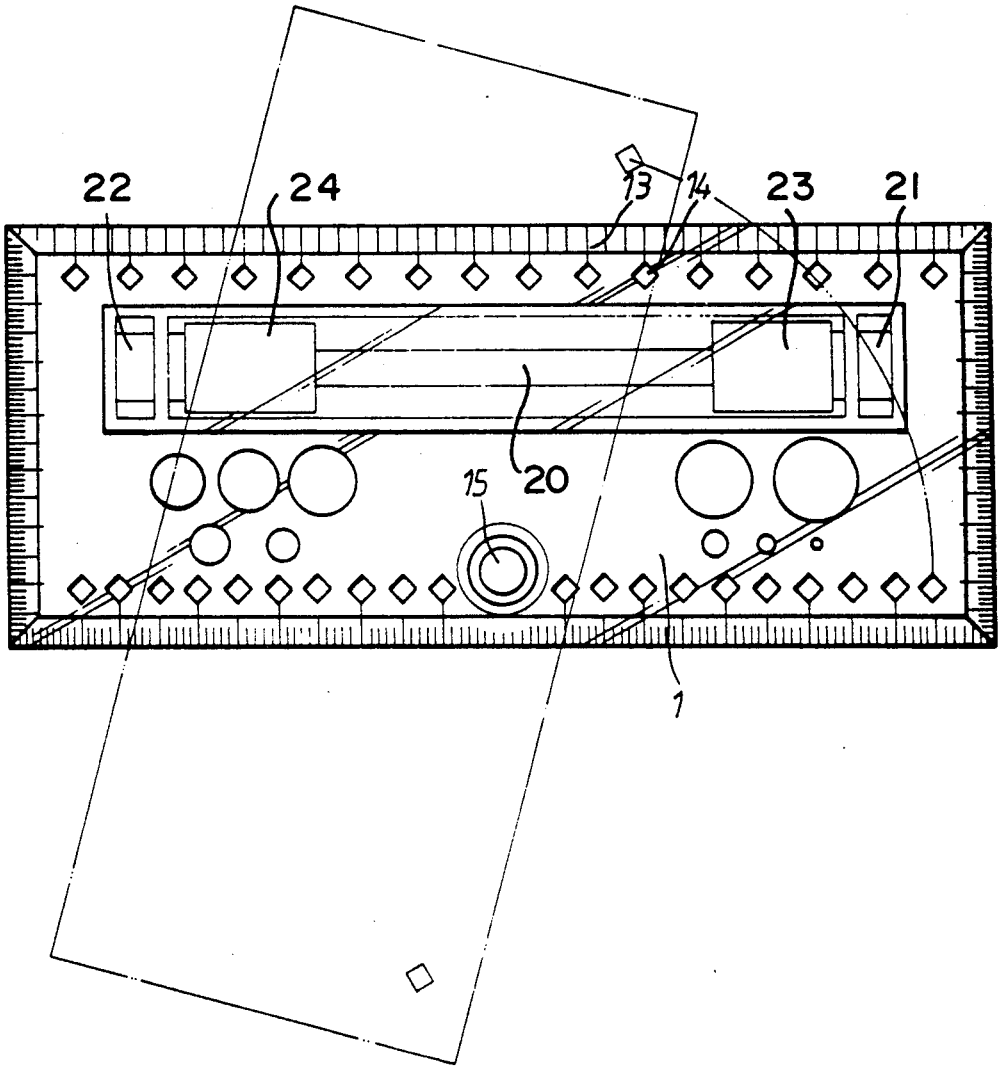
FIG. 6 shows another preferred use of the depicted embodiment of this invention.

As shown in FIGS. 5 and 6, the peripheral edge of the body of ruler 1 includes graduations 13; and perforations 14 are also located along the body of the ruler at predetermined graduations 13 corresponding to a desired unit, so that parallel lines of different sizes can be drawn at the same time. A circular axial block 15 is set at a laterally central position in the body of ruler 1. The circular axial block 15 protrudes slightly out the bottom edge of the body of ruler 1. With the circular axial block 15 functioning as an axial center by pressing one finger on it, by inserting a pen into a perforation 14 at the lateral side of circular axial block 15 and pushing the body of the ruler 1 to enable the body of ruler 1 to turn with the center of the forementioned circular axial block 15 as its axial center, circles of varying diameters can be drawn depending on the perforation 14 used as shown in FIG. 6.

Although described with respect to a particular embodiment of the invention, it should be understood that various changes and/or modifications can be made to the invention without departing from the spirit thereof. In general, the invention is only intended to be limited by the scope of the following claims.

I claim:

1. A multi-functional ruler comprising:

a body portion including a roller groove defining first and second spaced seats; and a roller assembly including an axial rod with first and second ends, a pair of rollers carried by said rod adjacent said first and second ends respectively such that an end portion of said rod extends beyond each of said rollers and defines a support block, and a pair of nuts adapted to rotatably receive said blocks, said roller assembly being arranged such that said nuts are tightly mounted within said seats of said body portion with said blocks therein to support said axial rod and permit rotation of said roller assembly relative to said body portion while preventing axial shifting of said axial rod relative to said body portion.

2. A multi-functional ruler as claimed in claim 1, further including an axial block extending through said body portion at a predetermined location thereon and defining a pivot point about which said body portion may rotate.

* * * * *